US005797658A

United States Patent [19]

Larrucea

[11] Patent Number: 5,797,658

[45] Date of Patent: Aug. 25, 1998

[54] SKATE WHEEL

[75] Inventor: Henry Larrucea, Huntington Beach, Calif.

[73] Assignees: Rollerblade, Inc., Minneapolis, Minn.; Elasco, Inc., Garden Grove, Calif.

[21] Appl. No.: 795,696

[22] Filed: Feb. 4, 1997

Related U.S. Application Data

[63] Continuation of Ser. No. 494,472, Jun. 26, 1995, abandoned.

[51] Int. Cl.[6] ..... B60C 7/24

[52] U.S. Cl. ..... 301/5.3; 152/323

[58] Field of Search ..... 301/5.3, 5.7, 64.7; 280/11.22, 11.23; 152/323, 393, 394

[56] References Cited

U.S. PATENT DOCUMENTS

| | | | |
|---|---|---|---|
| 2,665,521 | 1/1954 | Ford | 301/5.3 |
| 2,697,010 | 12/1954 | Hieaxhmufl . | |
| 3,501,162 | 3/1970 | Toone | 301/5.3 |
| 4,447,093 | 5/1984 | Cunard et al. | 152/323 |
| 4,909,523 | 3/1990 | Olson | 280/11.22 |
| 5,026,106 | 6/1991 | Biermann | 301/64.7 |
| 5,308,152 | 5/1994 | Ho | 152/323 |
| 5,310,250 | 5/1994 | Gonsior | 280/11.23 |
| 5,564,790 | 10/1996 | Lekavich | 301/5.3 |
| 5,630,891 | 5/1997 | Peterson et al. | 301/5.3 |

FOREIGN PATENT DOCUMENTS

| | | |
|---|---|---|
| 0 469 639 A2 | 2/1992 | European Pat. Off. . |
| 0 642 814 A1 | 3/1995 | European Pat. Off. . |
| 2 562 804 | 10/1985 | France . |
| 2562804 | 10/1985 | France . |

OTHER PUBLICATIONS

"Straight Wheels", Apr. 1996.

"Straight Wheels", Mar. 1996, Speed Skating Times, J.L.H. Publications, Inc., Pompano Beach, Florida.

*Primary Examiner*—Russell D. Stormer

*Attorney, Agent, or Firm*—Merchant, Gould, Smith, Edell, Welter & Schmidt, P.A.

[57] ABSTRACT

A wheel for an in-line skate includes a hub having a central core. First and second anchors extend radially from the core. The anchors are positioned on the core in spaced apart relation to define a material receiving volume between the anchors. A synthetic plastic material is molded to the core surrounding each of the anchors and filling the material receiving volume.

14 Claims, 2 Drawing Sheets

SKATE WHEEL

This is a Continuation of application Ser. No. 08/494,472, filed Jun. 26, 1995 and now abandoned.

BACKGROUND OF THE INVENTION

1. Field of the Invention

This invention pertains to wheeled skate devices. More particularly, this invention pertains to a novel hub design for a skate wheel.

2. Description of the Prior Art

Skating, particularly in-line skating, is becoming increasingly popular. Such skates include wheels fastened to a skate boot. The wheels typically include a hub of rigid plastic material. A synthetic plastic material is then molded onto the hub material. Examples of in-line skates and hubs are shown in U.S. Pat. Nos. Design 339,320; Design 330,884; and Design 330,883.

As shown in the above-referenced prior art patents, prior art skate hubs included a generally cylindrical core. Extending radially from the midpoint of the core is a protrusion. A plurality of holes are formed through the protrusion with the holes being circumferentially spaced about the axis of the core. The wheel material (urethane) is molded surrounding the hub. During the molding process, the urethane flows into the holes formed through the protrusion. As a result of the molding process, the material of the wheel is securely molded to the hub.

From time to time, a wheel may experience substantial side forces on the hub and wheel. The side forces can cause the molded urethane to break away from the hub (referred to as de-lamination). Furthermore, as the wheel wears, the diameter of the wheel decreases. Therefore, the distance between the outer periphery of the urethane material and the outer periphery of the central protrusion progressively decreases during wear of the wheel. As this distance decreases, the performance or bounce of the wheel decreases.

SUMMARY OF THE INVENTION

According to a preferred embodiment of the present invention, a wheel for a skate is disclosed having a hub with a central core with a bore formed therethrough for passing a wheel axle. First and second anchors are provided radially extending from the core with the anchors disposed in spaced apart relation to define a material receiving volume between the anchors. A synthetic plastic material is molded to the core and surrounding each of the anchors and at least partially filling the material receiving volume.

DESCRIPTION OF THE PREFERRED EMBODIMENT

Figure 2:
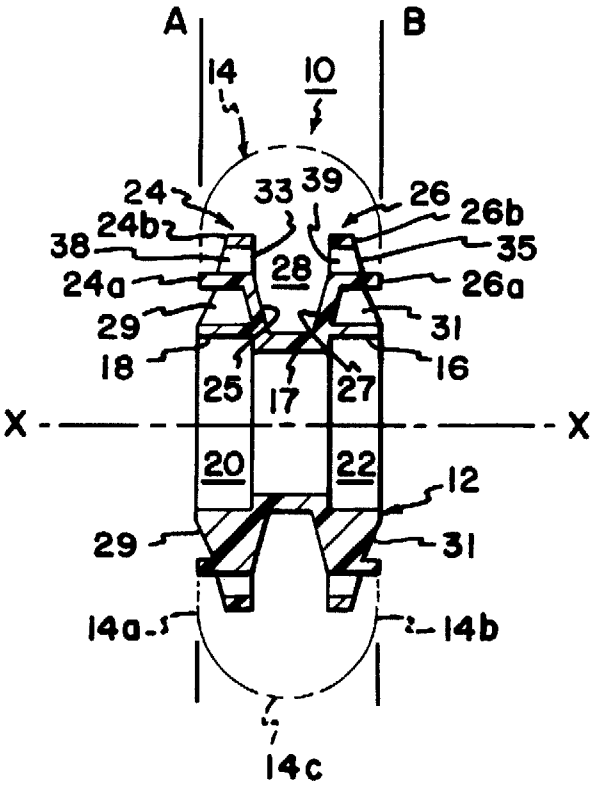
FIG. 2 is a view taken along line 2—2 of FIG. 1 and showing the outer periphery of the molded urethane in phantom lines for ease of illustration.
Figure 1:
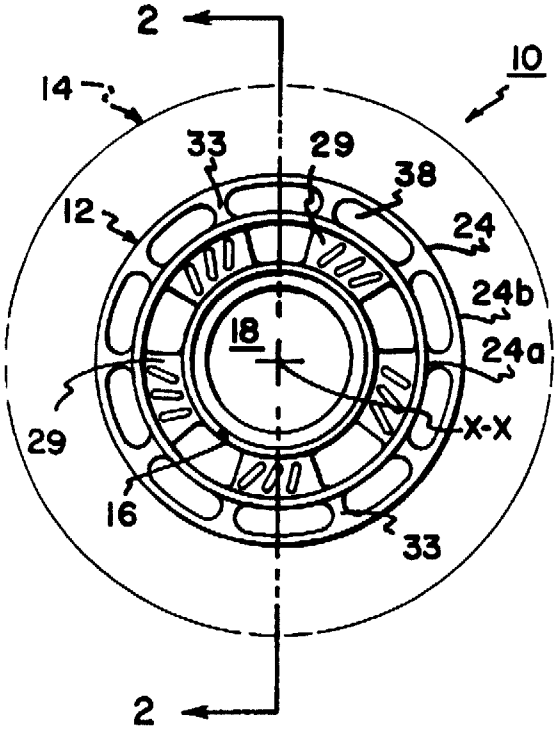
FIG. 1 is a side elevation view of a wheel according to the present invention with an outer periphery of a molded urethane wheel portion being shown in phantom lines for ease of illustration.

With reference now to the various drawing figures in which identical elements are numbered identically throughout, a description of the preferred embodiment of the present invention will now be provided.

With reference to the various drawing figures, a wheel 10 according to the present invention is shown. The wheel 10 includes a stiff synthetic plastic hub 12 and a molded urethane rim 14. For ease of illustration, in the various drawing figures, the urethane rim 14 is shown in phantom lines so that the various features and novel elements of the hub 12 may be clearly identified.

The hub 12 includes a central cylindrical core 16 surrounding a central axis X—X. The core 16 defines a bore 18 for passing an axle or the like on which the hub 12 may be mounted on a skate.

Figure 4:
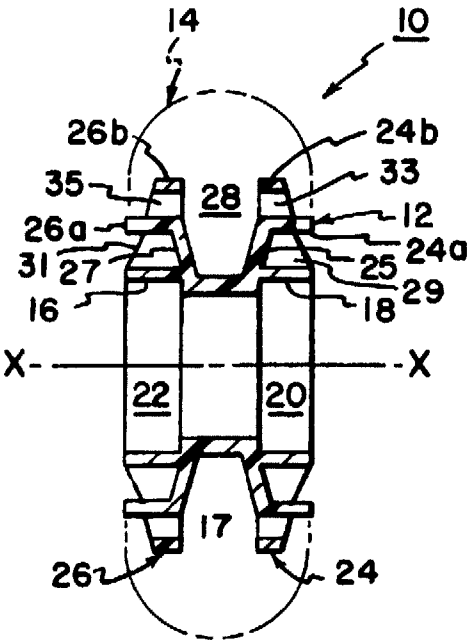
FIG. 4 is a view taken along line 4—4 of FIG. 3.

The core 16 includes a reduced diameter central portion 17 to separate the core into left and right side pockets 20,22 best shown in FIGS. 2 and 4. Pockets 20,22 may receive bearings or the like (not shown) which may be press fit into the pockets 20,22 as is conventional. The bearings are then rotatably mounted on an axle (not shown).

Figure 3:
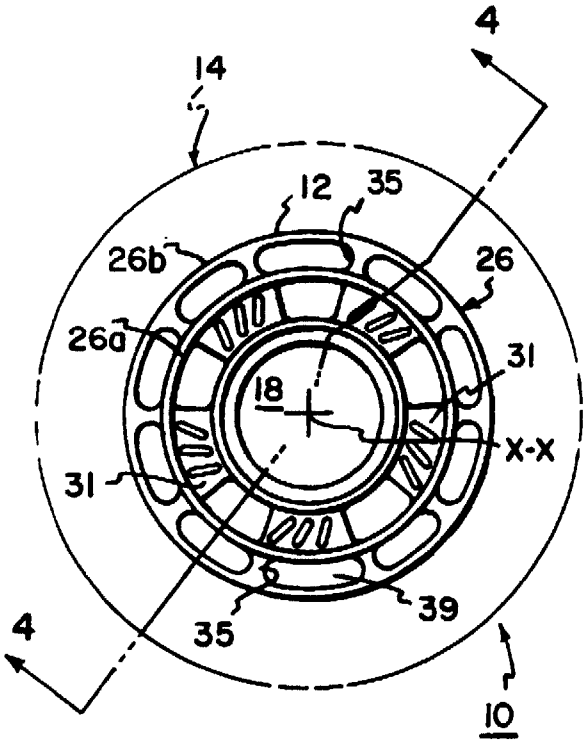
FIG. 3 is an elevation view of the wheel of FIG. 1 showing an opposite side thereof.

First and second anchors 24,26 are provided extending radially away from the core 16. The anchors 24,26 are provided in spaced apart relation to define a material receiving volume 28 therebetween. As best shown in FIGS. 3 and 4, the anchors 24,26 are generally positioned surrounding pockets 20,22 and are not positioned surrounding the reduced diameter central portion 17 such that the material receiving volume 28 is centrally positioned on the hub 12.

Each of the anchors 24,26 include first and second concentric collars or rings 24*a*,26*a* and 24*b*,26*b*. Each of the rings 24*a*,24*b*,26*a*,26*b* are coaxial with axis X—X and with rings 24*a* and 24*b* being in generally planar alignment with one another and with pocket 20. Rings 26*a*,26*b* are generally planar with one another and with pocket 16. Inner rings 24*a*,26*a* are held in spaced relation from the core 16 by support walls 25,27 and by support ribs 29,31. Rings 24*b*, 26*b* are supported on rings 24*a*,26*a* by support ribs 33,35. The support ribs 33,35 and rings 24*a*,24*b* and 26*a*,26*b* define a plurality of circumferentially spaced pathways 38,39 formed through each of the anchors 24,26 near the radial edges of the anchors 24,26.

With best reference to FIG. 2, the axial ends of the core 16 define planes A,B which are parallel and spaced apart. Each of rings 24*a*,26*a* are provided with axial lengths such that the rings 24*a*,26*a* terminate in planar alignment with planes A,B, respectively. Rings 26*b*,24*b* are spaced from planes A,B.

Phantom line 14 shows the outline of the urethane molded onto the hub 12. The urethane rim 14 presents side walls 14*a*,14*b* which are co-planar with planes A,B. The side walls extend radially outward from inner rings 24*a*,26*a* with the side walls 14*a*,14*b* projecting radially outwardly from axis X—X a distance greater than a radial extension of anchors 24,26. The flat side walls 14*a*,14*b* are joined by an arcuate periphery 14*c*.

With the construction thus described, the molded urethane 14 is molded onto the hub 12 with the urethane flowing through the passages 38,39 on both of anchors 24,26. This securely molds the urethane 14 to the hub 12.

Unlike the prior art, the present invention with two hubs or anchors 24,26 provides twice as many points of attachment to the anchors 24,26. Furthermore, with the anchors 24,26 spaced apart and not positioned centrally on the core 16, the urethane 14 presents a maximum thickness at a central position of wheel 10. Accordingly, as the wheel wears and the periphery of the rim 14 reduces, a substantial thickness of urethane remains by reason of the urethane occupying the material receiving volume 28. Accordingly, the performance of the wheel 10 is enhanced over the prior art. Additionally, by placing the anchors 24,26 in close proximity to both side walls 14*a*,14*b*, the wheel 10 presents greater resistance to breakage due to side loading forces acting on the rim 14 which would otherwise cause the material of the rim 14 to break away from the hub 12.

Having disclosed the present invention in a preferred embodiment, it will be appreciated that with the benefit of the present invention, those skilled in the art may come aware of modifications in equivalents of the disclosed concepts. It is intended that the present invention not be limited to the disclosed concepts that includes apparent modifications and equivalents.

What is claimed is:

1. A wheel for a skate comprising:

a hub having a central core with a center axis, said core defining a bore axially extending therethrough for passing an axle;

at least a first and a second anchor each having first and second rings radially spaced apart and connected by a plurality of circumferentially spaced ribs;

each of said first and second anchors extended to predetermined first and second radial distances, respectively, from said core, said first and second anchors disposed in axially spaced apart relation and defining a material receiving volume between said anchors;

a synthetic plastic material molded to said core, surrounding each of said first and second anchors, and at least partially filling said material receiving volume; and at least a portion of said material forming a radial thickness disposed between said first and second anchors, said thickness extending to a third radial distance from said core, said third radial distance greater than said first and second radial distances and of said first and second anchors, respectively, said third radial distance being the greatest radial distance of said material from said core and disposed at an axially centered mid-point of said hub.

2. A wheel according to claim 1 wherein said synthetic plastic material is molded onto said hub with said material presenting flat axial faces extending a fourth radial distance greater than said first and second radial distances of said anchors;

said material having an arcuate peripheral edge as seen in cross section around an entire circumference of said material; and said flat axial faces of said material joined by said arcuate peripheral edge of said material.

3. A wheel according to claim 2 wherein at least a portion of said thickness extends continuously from said core to outer perimeter of said wheel.

4. A wheel according to claim 1 wherein said material completely fills said material receiving volume.

5. A wheel according to claim 1 wherein said first and second radial distances of said first and second anchors are the same.

6. A wheel for a skate comprising:

a hub having a central core with a center axis, said core defining a bore axially extending therethrough for passing an axle;

at least a first and a second anchor, each of said first and second anchors extending radially from said core, with said first and second anchors extended to predetermined first and second radial distances, respectively, from said core;

said first and second anchors disposed in axially spaced apart relation and defining a material receiving volume therebetween, said material receiving volume including the entire area disposed between said first and second anchors;

a synthetic plastic material molded to said core and surrounding each of said first and second anchors and filling said material receiving volume, at least a portion of said material forming a radial thickness disposed between said first and second anchors, said thickness extending to a third radial distance from said core, said third radial distance being the greatest radial distance of said material from said core; and said material defining first and second axial faces each being substantially flat, said first and second axial faces defining axial planes in substantially parallel axially spaced apart relation;

said material having an arcuate peripheral edge as seen in cross-section around an entire circumference of said material, said arcuate peripheral edge joining said flat axial faces; and each of said first and second anchors having at least a first ring coaxial with said core and radially spaced from said core, said first rings disposed in axially spaced apart relation from each other, at least a portion of said first ring of said first anchor coterminous with said first axial plane, at least a portion of said first ring of said second anchor coterminous with said second axial plane;

wherein said first and second axial faces terminate at said first rings of said first and second anchors, respectively, and portions of said material radially aligned with said first and second anchors are disposed radially outward from said first rings of said first and second anchors, respectively.

7. The wheel according to claim 6 wherein said first and second radial distances of said first and second anchors are the same.

8. The wheel according to claim 6 wherein said first and second anchors define a plurality of open pathways, said pathways being in communication with said material receiving volume, said material molded within said pathways.

9. The wheel according to claim 6 wherein said first anchor further includes a second ring radially spaced from and coaxial with said first ring of said first anchor, said first anchor having circumferentially spaced ribs connecting said first and second rings of said first anchor; and wherein said second anchor further includes a second ring radially spaced from and coaxial with said first ring of said second anchor, said second anchor having circumferentially spaced ribs connecting said first and second rings of said second anchor.

10. The wheel according to claim 6 wherein said material completely fills said material receiving volume, said material receiving volume including the entire area disposed between said first and second anchor planes of said first and second anchors, respectively.

11. A wheel for a skate comprising:

a hub having a central core with a center axis, said core defining a bore axially extending therethrough for passing an axle;

at least a first and a second anchor, each of said first and second anchors extending radially from said core, with said first and second anchors extended to predetermined first and second radial distances, respectively, from said core;

said first and second anchors disposed in axially spaced apart relation and defining a material receiving volume therebetween;

a synthetic plastic material molded to said core and surrounding each of said first and second anchors and at least partially filling said material receiving volume, at least a portion of said material forming a continuous radial thickness disposed between said first and second anchors, said thickness continuously extending in a radial direction from said core to a third radial distance from said core, said third radial distance being the greatest radial distance of said material from said core and substantially disposed at an axially centered mid-point of said hub;

said material defining first and second axial faces each being substantially flat, said first and second axial faces defining axial planes in substantially parallel axially spaced apart relation;

said material having an arcuate peripheral edge as seen in cross-section around an entire circumference of said material, said arcuate peripheral edge joining said flat axial faces; and each of said first and second anchors having at least a first ring coaxial with said core and radially spaced from said core, said first rings disposed in axially spaced apart relation from each other, at least a portion of said first ring of said first anchor coterminous with said first axial plane, at least a portion of said first ring of said second anchor coterminous with said second axial plane;

wherein said first and second axial faces terminate at said first rings of said first and second anchors, respectively, and portions of said material radially aligned with said first and second anchors are disposed radially outward from said first rings of said first and second anchors, respectively.

12. The wheel according to claim 11 wherein said first and second radial distances of said first and second anchors are the same.

13. The wheel according to claim 11 wherein said first and second anchors define a plurality of open pathways, said pathways being in communication with said material receiving volume, said material molded within said pathways.

14. The wheel according to claim 11 wherein said first anchor further includes a second ring radially spaced from and coaxial with said first ring of said first anchor, said first anchor having circumferentially spaced ribs connecting said first and second rings of said first anchor; and wherein said second anchor further includes a second ring radially spaced from and coaxial with said first ring of said second anchor, said second anchor having circumferentially spaced ribs connecting said first and second rings of said second anchor.

* * * * *